US010358702B2

(12) United States Patent
Kawamura et al.

(10) Patent No.: US 10,358,702 B2
(45) Date of Patent: Jul. 23, 2019

(54) MAGNESIUM ALLOY AND PRODUCTION METHOD OF THE SAME

(71) Applicant: National University Corporation Kumamoto University, Kumamoto (JP)

(72) Inventors: Yoshihito Kawamura, Kumamoto (JP); Michiaki Yamasaki, Kumamoto (JP)

(73) Assignee: NATIONAL UNIVERSITY CORPORATION KUMAMOTO UNIVERSITY, Kumamoto (JP)

( * ) Notice: Subject to any disclaimer, the term of this patent is extended or adjusted under 35 U.S.C. 154(b) by 235 days.

(21) Appl. No.: 14/394,557

(22) PCT Filed: Apr. 16, 2013

(86) PCT No.: PCT/JP2013/061700

§ 371 (c)(1),
(2) Date: Oct. 15, 2014

(87) PCT Pub. No.: WO2013/157653

PCT Pub. Date: Oct. 24, 2013

(65) Prior Publication Data

US 2015/0090374 A1 Apr. 2, 2015

(30) Foreign Application Priority Data

Apr. 19, 2012 (JP) ..... 2012-096079

(51) Int. Cl.
*C22F 1/00* (2006.01)
*C22C 23/00* (2006.01)
(Continued)

(52) U.S. Cl.
CPC ..... *C22C 23/00* (2013.01); *B21B 3/00* (2013.01); *C22C 23/02* (2013.01); *C22F 1/00* (2013.01); *C22F 1/06* (2013.01); *Y10T 29/49988* (2015.01)

(58) Field of Classification Search
CPC . C22C 23/00; C22C 23/02; C22F 1/00; C22F 1/06
(Continued)

(56) References Cited

U.S. PATENT DOCUMENTS

2011/0033333 A1* 2/2011 Enami ..... C22C 1/0408 420/407
2011/0220251 A1 9/2011 Okamoto et al.

FOREIGN PATENT DOCUMENTS

EP 1 816 223 8/2007
JP 6-025790 2/1994
(Continued)

OTHER PUBLICATIONS

NPL-1: Shi et al, Microstructures and compressive properties of chill-cast Mg—Al—Ca alloys, J. Mater. Res., vol. 21, No. 3, Mar. 2006, (Year: 2006).*
(Continued)

*Primary Examiner* — Jie Yang
(74) *Attorney, Agent, or Firm* — Wenderoth, Lind & Ponack, L.L.P.

(57) ABSTRACT

To provide a magnesium alloy having high incombustibility, high strength and high ductility together. A magnesium alloy including Ca in an amount of "a" atomic %, Al in an amount of "b" atomic % and a residue of Mg, including $(Mg, Al)_2Ca$ in an amount of "c" volume %, wherein "a", "b" and "c" satisfy the following equations (1) to (4), and having the $(Mg, Al)_2Ca$ dispersed therein.

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 35 \quad (4)$$

12 Claims, 10 Drawing Sheets

(51) Int. Cl.

| | |
|---|---|
| ***B21B 3/00*** | (2006.01) |
| ***C22C 23/02*** | (2006.01) |
| ***C22F 1/06*** | (2006.01) |

(58) Field of Classification Search
USPC ..... 148/557
See application file for complete search history.

(56) References Cited

FOREIGN PATENT DOCUMENTS

| | | |
|---|---|---|
| JP | 2006-257478 | 9/2006 |
| JP | 2010-077516 | 4/2010 |
| JP | 2010-116620 | 5/2010 |
| JP | 2010-242146 | 10/2010 |

OTHER PUBLICATIONS

Extended European Search Report dated Mar. 21, 2016 in corresponding European patent application No. 13 77 8355.
Z. Yang et al., "Review on Research and Development of Magnesium Alloys", Acta Metallurgica Sinica, Editorial Board of Acta Metallurgica Sinica, Sheyang, CN, vol. 21, No. 5, Oct. 2, 2008, pp. 313-328.
International Search Report dated Jun. 18, 2013 in International (PCT) Application No. PCT/JP2013/061700.

* cited by examiner

| | |
|---|---|
| ① | Mg12.33 Al58.50 Ca29.16 |
| ② | Mg15.58 Al57.60 Ca26.80 |
| ③ | Mg18.78 Al51.27 Ca29.94 |
| ④ | Mg51.44 Al21.19 Ca27.36 |
| ⑤ | Mg19.67 Al49.15 Ca31.17 |

MAGNESIUM ALLOY AND PRODUCTION METHOD OF THE SAME

TECHNICAL FIELD

The present invention relates to a magnesium alloy and a production method thereof.

BACKGROUND ART

Mg—Al—Ca alloys have been developed mainly for die-casting materials. In addition, a hard compound is formed by addition of an excessive amount of Al and Ca which are solute elements, resulting in being brittle, and thus excellent mechanical properties cannot be obtained.

Accordingly, although a magnesium alloy in a low addition amount of Al, Ca has been developed, the strength has not yet been improved. In view of the above facts, as to studies of the Mg—Al—Ca alloy, studies of phase to be formed and studies limited to Mg—Al—Ca alloys in an extremely low addition amount of Al, Ca have been carried out.

Furthermore, in order to make the magnesium alloy practical, it is necessary to enhance incombustibility and to raise its ignition temperature. However, since when improving the incombustibility, there are many cases of lowering the mechanical properties, and the incombustibility and the mechanical properties is in a tradeoff relationship, it is difficult to enhance both of the properties.

DISCLOSURE OF THE INVENTION

An object of one aspect of the present invention is to provide a magnesium alloy having high incombustibility, high strength and high ductility together, or a production method thereof.

Hereinafter, various aspects of the present invention will be explained.

[1] A magnesium alloy:

including Ca in an amount of "a" atomic %, Al in an amount of "b" atomic % and a residue of Mg, including $(Mg, Al)_2Ca$ in an amount of "c" volume %, wherein "a", "b" and "c" satisfy the following equations (1) to (4), and having the $(Mg, Al)_2Ca$ dispersed therein.

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 35 \text{ (preferably } 10 \leq c \leq 30) \quad (4)$$

[2] A magnesium alloy:

including Ca in an amount of "a" atomic %, Al in an amount of "b" atomic % and a residue of Mg, including $(Mg, Al)_2Ca$ in an amount of "c" volume %, wherein "a", "b" and "c" satisfy the following equations (1) to (4), and having the $(Mg, Al)_2Ca$ dispersed therein.

$$3 \leq a \leq 7 \quad (1)$$

$$8 \leq b \leq 12 \quad (2)$$

$$1.2 \leq b/a \leq 3.0 \quad (3)$$

$$10 \leq c \leq 35 \text{ (preferably } 10 \leq c \leq 30) \quad (4)$$

[3] The magnesium alloy according to the above [1] or [2], wherein the magnesium alloy further comprises Zn in an amount of "x" atomic %, wherein "x" satisfies the following equation (20).

$$0 < x \leq 3 \text{ (preferably } 1 \leq x \leq 3) \quad (20)$$

[4] The magnesium alloy according to any one of the above [1] to [3], wherein the magnesium alloy further comprises $Al_{12}Mg_{17}$ in an amount of "d" volume %, wherein "d" satisfies the following equation (5).

$$0 < d \leq 10 \quad (5)$$

[5] The magnesium alloy according to any one of the above [1] to [4], wherein a crystal particle size of the dispersed $(Mg, Al)_2Ca$ is "e", wherein "e" satisfies the following equation (6).

$$1 \text{ nm} \leq e \leq 2 \text{ μm} \quad (6)$$

[6] The magnesium alloy according to any one of the above [1] to [5], wherein a volume fraction of region of the dispersed $(Mg, Al)_2Ca$ is "f"%, wherein "f" satisfies the following equation (7).

$$35 \leq f \leq 65 \quad (7)$$

[7] The magnesium alloy according to any one of the above [1] to [6], wherein an ignition temperature of the magnesium alloy is 850° C. or more.

[8] The magnesium alloy according to any one of the above [1] to [7], wherein the "a" and "b" satisfy the following equations (1') and (2').

$$4 \leq a \leq 6.5 \quad (1')$$

$$7.5 \leq b \leq 11 \quad (2')$$

[9] The magnesium alloy according to the above [8], wherein the "a" and "b" satisfy the following equation (3').

$$11/7 \leq b/a \leq 12/5 \quad (3')$$

[10] The magnesium alloy according to the above [8] or [9], wherein an ignition temperature of the magnesium alloy is 1090° C. or more.

[11] The magnesium alloy according to any one of the above [1] to [10], wherein when compression yield strength is "g" and tensile yield strength is "h", "g" and "h" of the magnesium alloy satisfy the following equation (8).

$$0.8 \leq g/h \quad (8)$$

[12] The magnesium alloy according to any one of the above [1] to [11], wherein the magnesium alloy contains at least one element selected from the group consisting of Mn, Zr, Si, Sc, Sn, Ag, Cu, Li, Be, Mo, Nb, W and a rare-earth metal in an amount of "i" atomic %, where "i" satisfies the following equation (9).

$$0 < i \leq 0.3 \quad (9)$$

[13] The magnesium alloy according to any one of the above [1] to [12], wherein the magnesium alloy contains at least one compound selected from the group consisting of $Al_2O_3$, $Mg_2Si$, SiC, MgO and CaO in an amount of "j" atomic % as an amount of metal atom in the compound, where "j" satisfies the following equation (10).

$$0<j\leq 5 \quad (10)$$

[14] A production method of a magnesium alloy, including the steps of:

forming a casting product in which Ca is contained in an amount of "a" atomic %, Al is contained in an amount of "b" atomic %, a residual part includes a composition of Mg, $(Mg, Al)_2Ca$ is contained in an amount of "c" volume %, wherein "a", "b" and "c" satisfy the following equations (1) to (4), by casting method, and subjecting the casting product to plastic working.

$$3\leq a\leq 7 \quad (1)$$

$$4.5\leq b\leq 12 \quad (2)$$

$$1.2\leq b/a\leq 3.0 \quad (3)$$

$$10\leq c\leq 35 \text{ (preferably } 10\leq c\leq 30) \quad (4)$$

[15] A production method of a magnesium alloy, comprising the steps of:

forming a casting product in which Ca is contained in an amount of "a" atomic %, Al is contained in an amount of "b" atomic %, a residual part includes a composition of Mg, $(Mg, Al)_2Ca$ is contained in an amount of "c" volume %, wherein "a", "b" and "c" satisfy the following equations (1) to (4), by casting method, and subjecting the casting product to plastic working.

$$3\leq a\leq 7 \quad (1)$$

$$8\leq b\leq 12 \quad (2)$$

$$1.2\leq b/a\leq 3.0 \quad (3)$$

$$10\leq c\leq 30 \quad (4)$$

[16] A production method of a magnesium alloy, comprising the steps of:

forming a casting product in which Ca is contained in an amount of "a" atomic %, Al is contained in an amount of "b" atomic %, Zn is contained in an amount of "x" atomic %, a residual part includes a composition of Mg, wherein "a", "b" and "x" satisfy the following equations (1) to (3) and (20), by casting method, and subjecting the casting product to plastic working.

$$3\leq a\leq 7 \quad (1)$$

$$4.5\leq b\leq 12 \quad (2)$$

$$1.2\leq b/a\leq 3.0 \quad (3)$$

$$0<x\leq 3 \quad (20)$$

[17] The production method of the magnesium alloy according to the above [16], wherein the casting product contains $(Mg, Al)_2Ca$ in an amount of "c" volume %, wherein "c" satisfies the following equation (4).

$$10\leq c\leq 35 \quad (4)$$

[18] The production method of the magnesium alloy according to any one of the above [14] to [17], wherein the casting product contains $Al_{12}Mg_{17}$ in an amount of "d" volume %, wherein "d" satisfies the following equation (5).

$$0<d\leq 10 \quad (5)$$

[19] The production method of the magnesium alloy according to any one of the above [14] to [18], wherein a cooling rate in forming the casting product is 1000 K/sec or less.

[20] The production method of the magnesium alloy according to any one of the above [14] to [19], wherein an equivalent strain in performing the plastic working is 2.2 or more.

[21] The production method of the magnesium alloy according to any one of the above [14] to [20], wherein the casting product is subjected to a heat treatment at a temperature of 400° C. to 600° C. for 5 minutes to 24 hours before performing the plastic working.

[22] The production method of the magnesium alloy according to any one of the above [14] to [21], wherein the "a" and "b" satisfy the following equations (1') and (2').

$$4\leq a\leq 6.5 \quad (1')$$

$$7.5\leq b\leq 11 \quad (2')$$

[23] The production method of the magnesium alloy according to the above [22], wherein the "a" and "b" satisfy the following equation (3').

$$11/7\leq b/a\leq 12/5 \quad (3')$$

[24] The production method of the magnesium alloy according to any one of the above [14] to [23], wherein a crystal particle size of the $(Mg, Al)_2Ca$ after the plastic working is "e", wherein "e" satisfies the following equation (6).

$$1 \text{ nm}\leq e\leq 2 \text{ μm} \quad (6)$$

[25] The production method of the magnesium alloy according to any one of the above [14] to [24], wherein a volume fraction of region of dispersed the $(Mg, Al)_2Ca$ after the plastic working is "f" %, where "f" satisfies the following equation (7).

$$35\leq f\leq 65 \quad (7)$$

[26] The production method of the magnesium alloy according to any one of the above [14] to [25], wherein after the plastic working, the magnesium alloy is subjected to heat treatment.

[27] The production method of the magnesium alloy according to any one of the above [14] to [25], wherein after the plastic working, the magnesium alloy is subjected to solution treatment.

[28] The production method of the magnesium alloy according to the above [27], wherein after the solution treatment, the magnesium alloy is subjected to aging treatment.

[29] The production method of the magnesium alloy according to any one of the above [14] to [28], wherein when compression yield strength is "g" and tensile yield strength is "h", "g" and "h" of the magnesium alloy satisfy the following equation (8).

$$0.8\leq g/h \quad (8)$$

[30] The production method of the magnesium alloy according to any one of the above [14] to [29], wherein the casting product contains at least one element selected from the group consisting of Mn, Zr, Si, Sc, Sn, Ag, Cu, Li, Be, Mo, Nb, W and a rare-earth metal in an amount of "i" atomic %, where "i" satisfies the following equation (9).

$$0<i\leq 0.3 \quad (9)$$

[31] The production method of the magnesium alloy according to any one of the above [14] to [30], wherein the casting product contains at least one compound selected from the group consisting of $Al_2O_3$, $Mg_2Si$, SiC, MgO and CaO in an amount of "j" atomic % as an amount of metal atom in the compound, where "j" satisfies the following equation (10).

$$0<j\leq 5 \quad (10)$$

By applying an aspect of the present invention, it is possible to provide a magnesium alloy having a high incombustibility, high strength and high ductility together, or a production method thereof.

BRIEF DESCRIPTION OF THE DRAWINGS

FIG. 13 is a diagram showing a dependency of ignition temperature on the Zn addition amount in the material of $Mg_{89}Al_{10}Ca_1Zn_x$ (x=0 to 2.0) alloy and the like.

DESCRIPTION OF THE PREFERRED EMBODIMENTS

Figure 1:
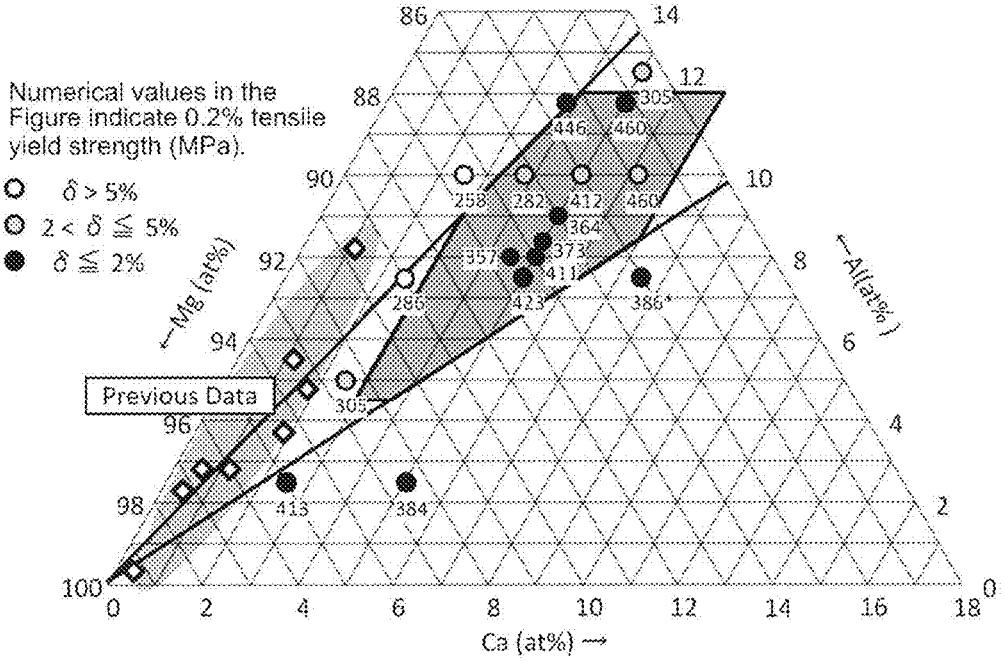
FIG. 1 is a diagram showing the results of subjecting the cast extruded material of $Mg_{100-a-b}Ca_aAl_b$ alloy to the tensile test at room temperature.

Hereinafter, the embodiments according to the present invention will be explained in detail by referring the drawings. However, the present invention is not limited to the following explanation, and a person skilled in the art can easily understand that the present invention can modify its embodiment and detail variously without departing from the gist and scope of the present invention. Therefore, the present invention should not be construed as being limited to the description of the embodiments shown in the following.

(Embodiment 1)

One embodiment of the present invention is to develop a wrought material having high strength by using a Mg—Al—Ca alloy being a magnesium alloy in which a solute element is added at a high concentration. Tensile yield strength and elongation of $Mg_{83.75}Al_{10}Ca_{6.25}$ extruded material which is one embodiment of the present invention and which exhibits excellent mechanical properties reach 460 MPa and 3.3%, respectively, which greatly exceed properties of the conventional Mg—Al—Ca alloy casting material and wrought material.

According to the conventional study, it has been reported that, in a Mg—Al—Ca alloy, the increase in a volume fraction of a compound containing Al and Ca decreases an ductility of the alloy, resulting in exhibiting brittleness.

However, in order to aim at developing a wrought material in the region of a high concentrated composition of Al and Ca in which a volume fraction of the compound becomes high, the inventors have found that high strength and relatively large ductility can be obtained by dispersing a hard Mg—Al—Ca based ternary compound, for example, $(Mg, Al)_2Ca$ that is C36-type compound, into a metallographic structure.

The advantage of the addition of Al to Mg is to enhance mechanical properties, to enhance corrosion resistance, and to contribute to weight saving because a specific gravity of Al is 2.70.

The advantage of the addition of Ca to Mg is to enhance incombustibility, to enhance mechanical properties, to enhance creep resistance, and to contribute to weight saving because a specific gravity of Ca is 1.55.

The magnesium alloy according to one embodiment of the present invention contains Ca in an amount of a atomic %, Al in an amount of "b" atomic % and a residue of Mg, contains $(Mg, Al)_2Ca$ that is a C36 compound in an amount of "c" volume %, where "a", "b" and "c" satisfy the following equations (1) to (4), and has the $(Mg, Al)_2Ca$ dispersed therein. Meanwhile, more preferably, "a" and "b" satisfy the following equations (1') and (2'), further more preferably "a" and "b" satisfy the following equation (3').

$$3\leq a\leq 7 \quad (1)$$

$$4.5\leq b\leq 12 \text{ (or } 8\leq b\leq 12) \quad (2)$$

$$1.2\leq b/a\leq 3.0 \quad (3)$$

$$10\leq c\leq 35 \text{ (preferably } 10\leq c\leq 30) \quad (4)$$

$$4\leq a\leq 6.5 \quad (1')$$

$$7.5\leq b\leq 11 \quad (2')$$

$$11/7\leq b/a\leq 12/5 \quad (3')$$

The reasons for limiting the contents of Al and Ca to the ranges of the aforementioned equations (1) and (2) are as follows.

When the Al content is more than 12 atomic %, a sufficient strength cannot be obtained.

When the Al content is less than 4.5 atomic %, sufficient ductility cannot be obtained.

When the Ca content is more than 7 atomic %, it is difficult to put the magnesium alloy into a solidified state and thus is difficult to perform plastic working.

When the Ca content is less than 3 atomic %, a sufficient incombustibility cannot be obtained.

In the above magnesium alloy, the component other than Al and Ca having the contents of the aforementioned ranges is magnesium, and an impurity and other element may be contained to the extent that the alloy properties are not affected. Namely, the above wording "a residue of Mg" means not only the case where the residual part is all Mg, but also the case where the residual part contains an impurity and other element to the extent that the alloy properties are not affected.

Since the above $(Mg, Al)_2Ca$ is a hard compound, high strength can be obtained by reducing the size of the hard compound and then dispersing the compound. In other words, in order to obtain high strength, it is preferable to disperse, at a high volume fraction, the $(Mg, Al)_2Ca$ of the hard compound in a metallographic structure. Meanwhile, the dispersion degree of the $(Mg, Al)_2Ca$ is preferably $1/\mu m^2$ or more.

In addition, the $(Mg, Al)_2Ca$ is equiaxed crystal, and an aspect ratio of a crystal particle of the $(Mg, Al)_2Ca$ is approximately 1.

The above magnesium alloy preferably contains $A_{12}Mg_{17}$ (β phase) in an amount of "d" volume %, and the "d" satisfies the following equation (5). The β phase is not necessarily an essential phase, but is inevitably generated depending on composition.

$$0<d\leq 10 \quad (5)$$

Furthermore, a crystal particle size of the dispersed $(Mg, Al)_2Ca$ as described above is "e", and "e" may satisfy the following equation (6).

$$1\ \text{nm}\leq e\leq 2\ \mu\text{m} \quad (6)$$

Moreover, when the crystal size of the $(Mg, Al)_2Ca$ as described above is 2 μm or less, a magnesium alloy having high strength can be obtained.

However, the above equation (6) does not mean that the whole $(Mg, Al)_2Ca$ in the magnesium alloy is not able to be highly reinforced as long as it has the crystal particle size of 2 μm or less, but means that the magnesium alloy having a high strength can be obtained if a main portion of the $(Mg, Al)_2Ca$ has a particle size of 2 μm or less, for example, if 50 volume % or more of the $(Mg, Al)_1Ca$ in the magnesium alloy has a particle size of 2 μm or less. Meanwhile, the reason why a main portion of the $(Mg, Al)_2Ca$ may have a particle size of 2 μm or less is that there is a case where the $(Mg, Al)_2Ca$ having a crystal particle size of more than 2 μm is present in the magnesium alloy.

As described above, a volume fraction of region of the dispersed $(Mg, Al)_2Ca$ is "f"%, and the "f" preferably satisfies the following equation (7), more preferably satisfies the following equation (7').

$$35\leq f\leq 65 \quad (7)$$

$$35\leq f\leq 55 \quad (7')$$

In the magnesium alloy, there exist a compound-free region in which the C36-type compound is not dispersed, and a compound-dispersed region in which the C36-type compound is dispersed. This compound-dispersed region means the aforementioned region in which the $(Mg, Al)_2Ca$ is dispersed.

The compound-dispersed region contributes to the enhancement of the strength, and the compound-free region contributes the enhancement of the ductility. Therefore, as the compound-dispersed region is larger, the strength can be increased, and as the compound-free region is larger, the ductility can be increased. Accordingly, when the volume fraction f of region of the dispersed $(Mg, Al)_2Ca$ in the magnesium alloy satisfies the aforementioned equation (7) or (7'), the ductility can be enhanced while the high strength is maintained.

As mentioned above, by containing Ca in an amount of 3 atomic % or more in Mg, an ignition temperature of the magnesium alloy can be made 900° C. or more.

Furthermore, as described above, by containing Ca in an amount of 4 atomic % or more in Mg, an ignition temperature of the magnesium alloy can be made 1090° C. or more (boiling point or more). When an ignition temperature is a boiling point of the magnesium alloy or more, it can also be said that the magnesium alloy is substantially incombustible.

In addition, in the aforementioned magnesium alloy, when compression yield strength is g and tensile yield strength is h, "g" and "h" satisfy the following equation (8).

$$0.8\leq g/h \quad (8)$$

Since compression yield strength/tensile yield strength of the conventional magnesium alloy is 0.7 or less, it can be said that the magnesium alloy according to the present embodiment has high strength in this regard.

Furthermore, the magnesium alloy may contain at least one element selected from the group consisting of Mn, Zr, Si, Sc, Sn, Ag, Cu, Li, Be, Mo, Nb, W and a rare-earth metal in an amount of "i" atomic %, and "i" may satisfy the following equations (9). Therefore, it is possible to improve various properties (for example corrosion resistance) while maintaining the high incombustibility, high strength and high ductility together.

$$0<i\leq 0.3 \quad (9)$$

Moreover, the magnesium alloy may contain at least one compound selected from the group consisting of $Al_2O_3$, $Mg_2Si$, SiC, MgO and CaO in an amount of "j" atomic % as an amount of metal atom in the compound, where "j" may satisfy the following equations (10), more preferably satisfy the following equation (10'). Accordingly, it is possible to improve various properties while maintaining high incombustibility, high strength and high ductility together.

$$0<j\leq 5 \quad (10)$$

$$0<j\leq 2 \quad (10')$$

According to the present embodiment, by dispersing a hard compound Mg—Al—Ca-based ternary compound into a metallographic structure, it is possible to enhance mechanical properties, to obtain high strength and relatively large ductility, and at the same time, to enhance incombustibility.

In addition, the magnesium alloy may include Zn in an amount of "x" atomic %, and "x" may satisfy the following equation (20).

$$0<x\leq 3\ (\text{preferably } 1\leq x\leq 3,\ \text{more preferably } 1\leq x\leq 2) \quad (20)$$

By containing Zn as described above, the strength and ignition temperature can be enhanced.

(Embodiment 2)

The production method of the magnesium alloy according to one embodiment of the present invention will be explained.

At first, a casting product formed of the magnesium alloy is produced by melt-casting method. The composition of the magnesium alloy is the same as that in Embodiment 1. The casting product has the Mg—Al—Ca ternary compound the same as that in Embodiment 1, and may contain $Al_{12}Mg_{17}$.

Meanwhile, a cooling speed at the time of casting by the melt-casting is 1000 K/sec or less, preferably 100 K/sec or less.

Next, by subjecting the casting product having the Mg—Al—Ca ternary compound of a hard compound to plastic working, the Mg—Al—Ca ternary compound is finely dispersed, with the result that the magnesium alloy can obtain high strength and relatively large ductility and also can enhance its incombustibility. Meanwhile, an equivalent strain in performing the plastic working is preferably 2.2 or more (corresponding to an extrusion ratio of 9 or more).

Examples of the plastic working method include extrusion method, ECAE (equal-channel-angular-extrusion) processing method, rolling method, drawing and forging method, a method in which these processing are repeated, FSW processing and the like.

When performing the plastic working by extrusion, an extrusion temperature is preferably set to 250° C. or more and 500° C. or less, and a reduction in area by extrusion is set to 5% or more.

The ECAE processing method is a method in which a longitudinal direction of a sample is rotated by 90 degrees for every pass in order to introduce a uniform strain to the sample. Specifically, the ECAE processing method is a method in which the magnesium alloy cast that is a molding material is forced to be entered into a molding pore in a molding die obtained by forming the molding pore having a cross-sectional shape of L-shape, and then application of stress to the magnesium alloy cast particularly by the part in which the L-shape molding pore is bended at 90 degrees gives a molded article having excellent strength and toughness. A number of the passes of the ECAE is preferably 1 to 8 passes, more preferably 3 to 5 passes. A temperature at the time of processing of the ECAE is preferably 250° C. or more and 500° C. or less.

When performing the plastic working by rolling, it is preferable that a rolling temperature is set to 250° C. or more and 500° C. or less, and a draft is set to 5% or more.

When performing the plastic working by drawing, it is preferable that a temperature at the time of the drawing is 250° C. or more and 500° C. or less, and a reduction in area of the drawing is 5% or more.

When performing the plastic working by forging, it is preferable that a temperature at the time of forging processing is 250° C. or more and 500° C. or less, and a processing rate of the forging processing is 5% or more.

As explained above, since the hard compound is finely dispersed in the plastic-worked article obtained by subjecting the magnesium alloy to the plastic working, the mechanical properties such as strength and ductility can be enhanced drastically in comparison with those of before the plastic working.

In addition, before the above plastic working, the casting product may be subjected to a heat treatment at a temperature of 400° C. to 600° C. for 5 minutes to 24 hours. The ductility can be increased by the heat treatment.

A crystal particle size of the $(Mg, Al)_2Ca$ in the magnesium alloy after the plastic working is "e", and "e" may satisfy the following equation (6). In this way, when the crystal size is 2 μm or less, a highly strong magnesium alloy can be obtained.

$$1\text{nm} \leq e \leq 2\mu\text{m} \quad (6)$$

Furthermore, a volume fraction of region of the dispersed $(Mg, Al)_2Ca$ in the magnesium alloy after the plastic working is "f" %, and "f" may satisfy the following equation (7), and "f" may more preferably satisfy the following equation (7').

$$35 \leq f \leq 65 \quad (7)$$

$$35 \leq f \leq 55 \quad (7')$$

The volume fraction f of region of the dispersed $(Mg, Al)_2Ca$ in the magnesium alloy satisfies the above equation (7) or (7'), and thus it is possible to enhance the ductility while maintaining the high strength.

Moreover, when compression yield strength is "g" and tensile yield strength is "h", the "g" and "h" of the magnesium alloy after the above plastic working may satisfy the following equation (8).

$$0.8 \leq g/h \quad (8)$$

In addition, after the above plastic working, the magnesium alloy may be subjected to heat treatment at a temperature of 175° C. to 350° C. for 30 minutes to 150 hours. Thereby, precipitation strengthening occurs to thereby increase hardness.

In addition, after the plastic working, the magnesium alloy may be subjected to a solution treatment at a temperature of 350° C. to 560° C. for 30 minutes to 12 hours. Thereby, a solid solution of a solute element, into a mother phase, which is required for the formation of a precipitate is promoted.

Furthermore, after the solution treatment, the magnesium alloy may be subjected to an aging treatment at a temperature of 175° C. to 350° C. for 30 minutes to 150 hours. Thereby, precipitation strengthening occurs to thereby increase hardness.

(Embodiment 3)

The magnesium alloy according to this embodiment is obtained by preparing a magnesium alloy material having the Mg—Al—Ca ternary compound in the same way as that in Embodiment 2, by producing a plurality of chip-like cut articles of some mm or less square produced by cutting the magnesium alloy material, and then by solidifying the cut articles through application of shear. As the solidifying method, there may be employed, for example, a method of packing the cut article into a can, of pushing the cut article by using a stick member having the same shape as the inner side shape of the can, and of solidifying the cut articles through application of shear.

In the present embodiment, the same effects as those in Embodiment 2 can be obtained.

Furthermore, the magnesium alloy obtained by solidifying the chip-like cut article is a magnesium alloy having higher strength and higher ductility than a magnesium alloy without cutting and solidification. Moreover, the magnesium alloy obtained by solidifying the cut article may be subjected to plastic working.

Meanwhile, the magnesium alloys according to the above Embodiments 1 to 3 can be used as parts used under a high temperature atmosphere such as parts for airplanes, parts for cars, particularly piston, valve, lifter, tappet, sprocket for internal-combustion engine, etc.

EXAMPLE (Production of Samples)

First, ingots (casted material) such as $Mg_{100-a-b}Ca_aAl_b$ alloy (a: 2.5 to 7.5 at. %, b: 2.5 to 12.5 at. %) having the compositions shown in Table 1 are produced by a high-frequency induction melting in an Ar gas atmosphere, and then extrusion billets are prepared by cutting these ingots into a shape of ϕ29×65 mm. Consequently, the extrusion billets are subjected to the extrusion processing under the conditions shown in Table 1. The extrusion processing was performed in an extrusion ratio of 5, 7.5, 10, at an extrusion temperature of 523 K, 573 K, 623 K, at an extrusion speed of 2.5 mm/sec.

(Mechanical Properties of Cast Extruded Material)

A tensile test and a compression test were performed at room temperature, with respect to the cast extruded material of $Mg_{100-a-b}Ca_aAl_b$ alloy and the like which were subjected to the above extrusion processing. The results are shown in Table 1, FIG. 1 and FIG. 2. Meanwhile, "*" in FIG. 1 and FIG. 2 indicates elastic region breaking. In the tensile properties of Table 1, YS indicates 0.2% tensile yield strength, UTS indicates tensile strength, and in the compression properties of Table 1, YS indicates 0.2% compression yield strength, UTS indicates compression strength.

The first composition region which is enclosed by a thick line and hatched as shown in FIG. 1 indicates a magnesium alloy in which Ca is contained in an amount of "a" atomic %, Al is contained in an amount of "b" atomic %, a residual part includes a composition of Mg, and "a" and "b" satisfy the following equations (1) to (3).

$$3 \leq a \leq 7 \quad (1)$$

$$4.5 \leq b \leq 12 \quad (2)$$

$$1.2 \leq b/a \leq 3.0 \quad (3)$$

Figure 2:
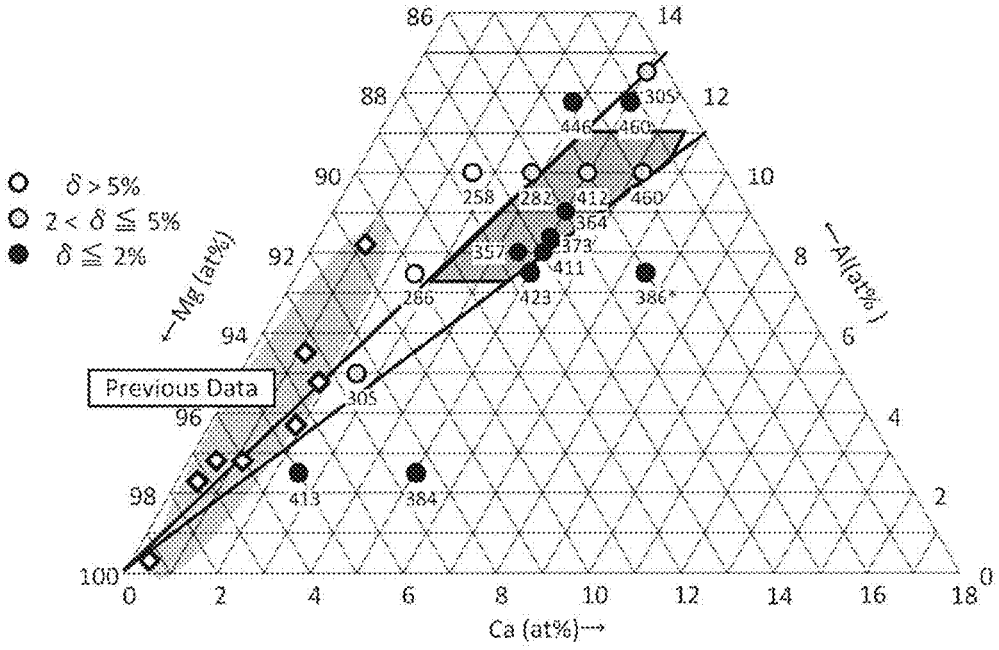
FIG. 2 is a diagram showing the results of subjecting the cast extruded material of $M_{100-a-b}Ca_aAl_b$ alloy to the tensile test at room temperature.

The second composition region which is enclosed by a thick line and hatched as shown in FIG. 2 indicates a magnesium alloy in which the above "a" and "b" satisfy the following equations (1') to (3').

$$4 \leq a \leq 6.5 \quad (1')$$

$$7.5 \leq b \leq 11 \quad (2')$$

$$11/7 \leq b/a \leq 12/5 \quad (3')$$

In FIG. 1 and FIG. 2, the 0.2% tensile yield strength (MPa) and the ductility (hereinafter abbreviating as δ) of

TABLE 1

| | Extrusion condition | | Mechanical properties | | | | | |
|---|---|---|---|---|---|---|---|---|
| | | Extrusion ratio | Tensile properties | | | Compression properties | | |
| Alloy composition (at %) | Extrusion temperature (K) | Equivalent strain being in the parenthesis | YS (MPa) | UTS (MPa) | Elon-gation (%) | YS (MPa) | UTS (MPa) | Elon-gation (%) |
| Mg87.5—Al10—Ca2.5 | 523 | 10 (2.3) | 258 | 350 | 7.8 | | | |
| Mg86.25—Al10—Ca3.75 | 523 | 10 (2.3) | 282 | 342 | 2.8 | | | |
| Mg85—Al10—Ca5 | 523 | 10 (2.3) | 412 | 459 | 3.3 | 395 | Interrupted in the middle | >10 (Interrupted in the middle) |
| | | 7.5 (2.01) | 338 | 379 | 1.24 | | | |
| | | 5 (1.61) | 348 | 425 | 1.72 | | | |
| Mg83.75—Al10—Ca6.25 | 523 | 10 (2.3) | 460 | 495 | 3.3 | 441 | 562 | 5.6 |
| Mg82.5—Al10—Ca7.5 | 523 | 10 (2.3) | Elastic region breaking | 430 | Elastic region breaking | | | |
| Mg95—Al2.5—Ca2.5 | 523 | 10 (2.3) | 413 | 487 | 1.8 | | | |
| Mg92.5—Al5—Ca2.5 | 523 | 10 (2.3) | 305 | 437 | 3.5 | | | |
| Mg90—Al7.5—Ca2.5 | 523 | 10 (2.3) | 286 | 364 | 5.8 | | | |
| Mg87.5—Al7.5—Ca5 | 523 | 10 (2.3) | 423 | 447 | 1.2 | | | |
| Mg83.75—Al11.25—Ca5 | 523 | 10 (2.3) | 460 | 395 | 1.38 | | | |
| Mg82.5—Al12.5—Ca5 | 523 | 10 (2.3) | 305 | 377 | 5.6 | | | |
| Mg85—Al8.75—Ca6.25 | 523 | 10 (2.3) | Elastic region breaking | 415 | Elastic region breaking | | | |
| Mg87.5—Ca4.5—Al8 | 523 | 10 (2.3) | 357 | 431 | 1.8 | | | |
| Mg87—Ca5—Al8 | 523 | 10 (2.3) | 411 | 487 | 1.6 | | | |
| Mg86.75—Ca5—Al8.25 | 523 | 10 (2.3) | 373 | 415 | 0.9 | | | |
| Mg86—Ca5—Al9 | 523 | 10 (2.3) | 364 | 418 | 1 | | | |
| Mg84—Ca8—Al8 | 523 | 10 (2.3) | | | Impossible to extrude | | | |
| | 573 | 10 (2.3) | | | Impossible to extrude | | | |
| Mg83.85—Ca8—Al8—Mn0.15 | 523 | 10 (2.3) | | | Impossible to extrude | | | |
| | 573 | 10 (2.3) | | | Impossible to extrude | | | |
| | 623 | 10 (2.3) | | | Impossible to extrude | | | |
| Mg85—Al8—Ca7 | 523 | 10 (2.3) | | | Impossible to extrude | | | |
| | 573 | 10 (2.3) | Elastic region breaking | — | Elastic region breaking | | | |
| Mg85—Al7.5—Ca7.5 | 523 | 10 (2.3) | | | Impossible to extrude | | | |
| | 573 | 10 (2.3) | Elastic region breaking | — | Elastic region breaking | | | |
| Mg77.5—Al15—Ca7.5 | 523 | 10 (2.3) | | | Impossible to extrude | | | |
| | 573 | 10 (2.3) | 387 | 426 | 0.77 | | | |

enclosed the cast extruded material of $Mg_{100-a-b}Ca_aAl_b$ alloy are shown in a ternary system strength diagram. In FIG. 1 and FIG. 2, one that is more than 5% is indicated as a white circle, one that is more than 2% and 5% or less is indicated as a gray circle, and one that is 2% or less is indicated as a black circle.

It has been confirmed that, in order to obtain the magnesium alloy exhibiting mechanical properties of high strength and high ductility, it is preferable to be within the first composition range shown in FIG. 1, and it is more preferable to be within the second composition range shown in FIG. 2. Furthermore, as shown in FIG. 1 and FIG. 2, it is found that the alloy group in which the addition amount of Al is 10 atomic % exhibits high strength and ductility.

Moreover, as shown in Table 1, it has been confirmed that a ratio of compression yield strength/tensile yield strength is 0.8 or more.

(Structural Observation of Cast Extruded Material)

Figure 3:
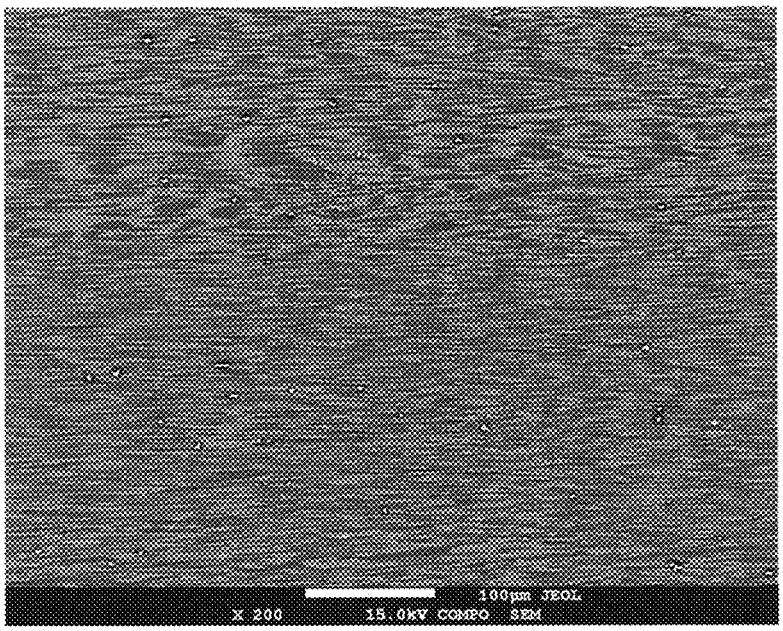
FIG. 3 is a structure photograph (SEM image) of the extruded material of $Mg_{85}Al_{10}Ca_5$ alloy.

In FIG. 3, a structure photograph (SEX image) of the $Mg_{85}Al_{10}Ca_5$ alloy extruded material among the samples produced according to the above method. In the $Mg_{85}Al_{10}Ca_5$ alloy extruded material, it is observed that the $(Mg, Al)_2Ca$ (C36-type compound) is effectively dispersed, and the $(Mg, Al)_2Ca$ is dispersed at a high volume fraction into the metallographic structure.

Among the samples produced according to the above method, from the SEM image of the $Mg_{100-a-b}Ca_aAl_b$ alloy extruded material in the first composition range shown in FIG. 1, it has been confirmed that the volume fraction of region of the dispersed $(Mg, Al)_2Ca$ is 35% or more and 65% or less, and it has been confirmed that the $Mg_{100-a-b}Ca_aAl_b$ alloy extruded material having more excellent mechanical properties (high strength and high ductility) has a volume fraction of 35% or more and 55% or less.

Furthermore, among the samples produced according to the above method, a degree of dispersion of the $(Mg, Al)_2Ca$ is observed from the SEM image of the $Mg_{100-a-b}Ca_aAl_b$ alloy extruded material in the first composition range shown in FIG. 1, and as a result, it has been confirmed that the degree of dispersion is approximately $1/\mu m^2$ or more. Moreover, among the samples produced according to the above method, an aspect ratio of the $(Mg, Al)_2Ca$ crystal particles is observed from the SEM image of the $Mg_{100-a-b}Ca_aAl_b$ alloy extruded material in the first composition range shown in FIG. 1, and as a result, it has been confirmed that the aspect ratio is approximately 1 and the particles are equiaxed crystals.

In addition, among the samples produced according to the above method, it has been confirmed that an upper limit of the crystal size of the $(Mg, Al)_2Ca$ is 2 μm from the SEM image of the $Mg_{100-a-b}Ca_aAl_b$ alloy extruded material in the first composition range shown in FIG. 1.

Figure 4:
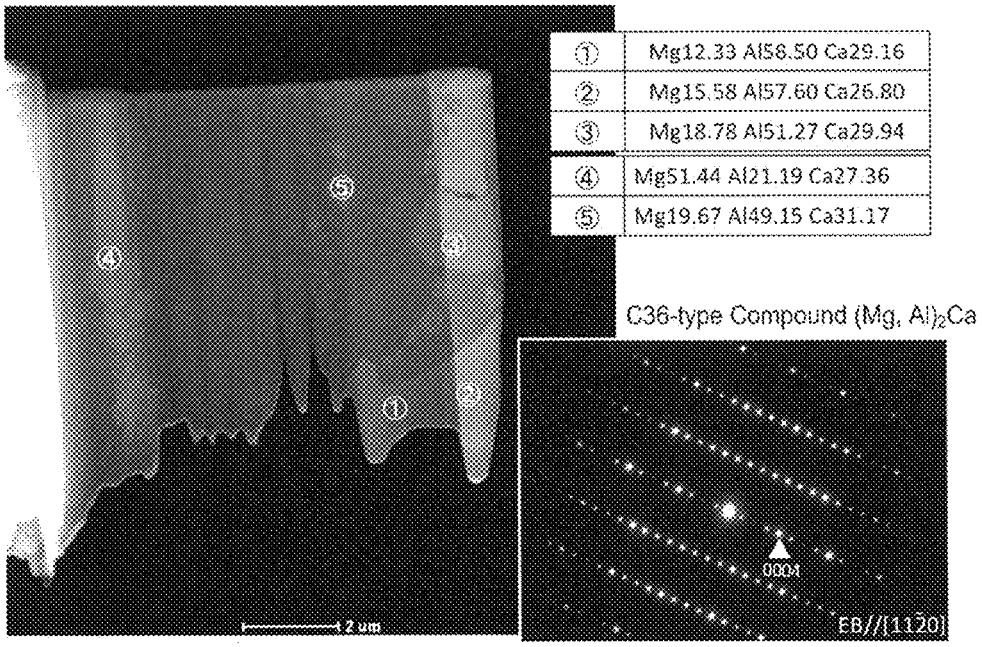
FIG. 4 is a diagram showing the TEM image and the electron beam diffraction pattern of the $(Mg, Al)_2Ca$ in the extruded material of $Mg_{83.75}Al_{10}Ca_{6.25}$ alloy.

FIG. 4 shows a TEM image and the electron beam diffraction pattern of the $(Mg, Al)_2Ca$ in the extruded material of $Mg_{83.75}Al_{10}Ca_{6.25}$ as alloy among the samples produced according to the above method.

As shown in FIG. 4, the presence of the $(Mg, Al)_2Ca$ can be confirmed by TEM, and it has been confirmed that the compound is $(Mg, Al)_2Ca$.

Furthermore, among the samples produced according to the above method, many $(Mg, Al)_2Ca$ crystal sizes each having 10 nm or less are observed from the TEM image of the $Mg_{100-a-b}Ca_aAl_b$ alloy extruded material in the first composition range shown in FIG. 1, and it is observed that the lower limit is 1 nm.

Figure 5:
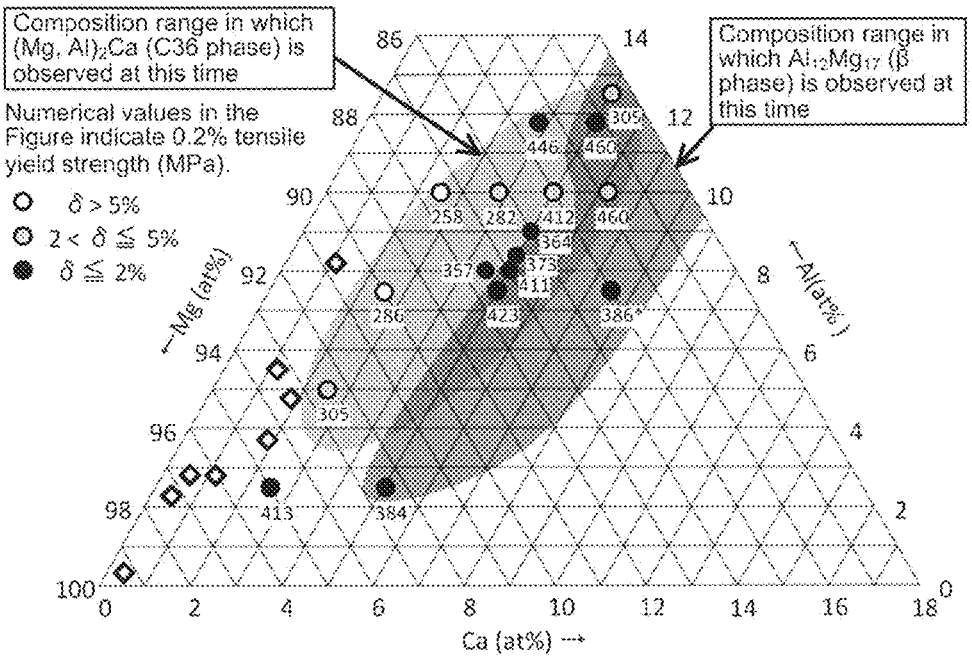
FIG. 5 is a diagram showing the phase formation and the mechanical properties of the extruded material of $Mg_{100-a-b}Ca_aAl_b$ alloy (a: 2.5 to 7.5 at. %, b: 2.5 to 12.5 at. %).

FIG. 5 is a diagram showing the formed phase and the mechanical properties of the extruded material of $Mg_{100-a-b}Ca_aAl_b$ alloy (a: 2.5 to 7.5 at. %, b: 2.5 to 12.5 at. %).

According to FIG. 5, in the first composition range shown in FIG. 1 and the second composition range shown in FIG. 2, it has been confirmed that there exist a range in which the $(Mg, Al)_2Ca$ is formed and a range in which the $(Mg, Al)_2Ca$ and $Al_{12}Mg_{17}$ are formed.

In addition, by measurement of the formed phases, it has been confirmed that the magnesium alloy within the first composition range shown in FIG. 1 contains the $(Mg, Al)_2Ca$ in an amount of 10% by volume or more and 35% by volume or less, and the $Al_{12}Mg_{17}$ of 0% by volume or more and 10% by volume or less.

Figure 6:
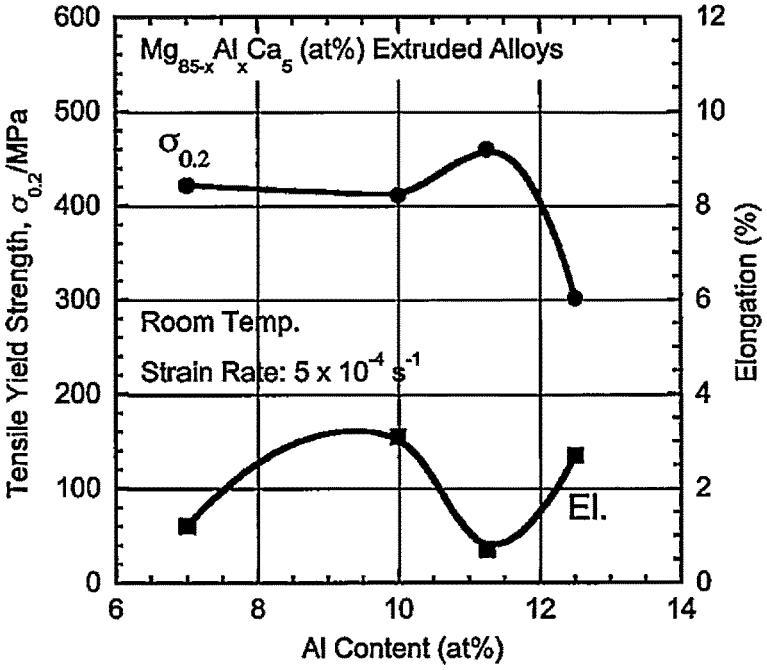
FIG. 6 is a diagram showing a dependency of mechanical properties on the Al addition amount in the extruded material of $Mg_{95-x}Al_xCa_5$ alloy.

FIG. 6 is a diagram showing a dependency of mechanical properties on the Al addition amount in the extruded material of $Mg_{95-x}Al_xCa_5$ alloy, and the horizontal axis indicates an Al content x and the vertical axis indicates 0.2% tensile yield strength YS.

As shown in FIG. 6, it has been confirmed that when the Al addition amount is more than 12 atomic %, the 0.2% tensile yield strength is drastically decreased, and it is found that the upper limit of the Al addition amount is preferably 12 atomic %, more preferably 11 atomic %.

Figure 7:
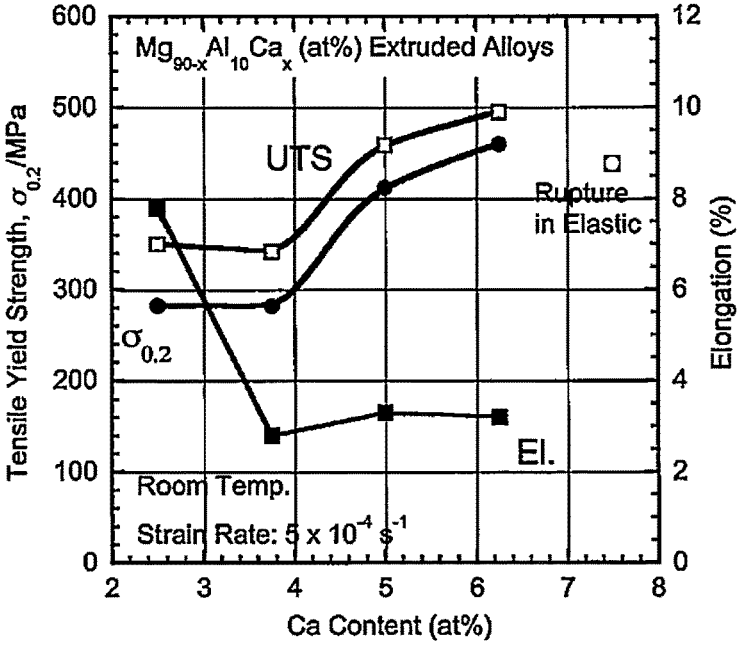
FIG. 7 is a diagram showing a dependency of mechanical properties on the Ca addition amount in the extruded material of $Mg_{90-x}Al_{10}Ca_x$ alloy.

FIG. 7 is a diagram showing a dependency of mechanical properties on the Ca addition amount in the extruded material of $Mg_{90-x}Al_{10}Ca_x$ alloy, and the horizontal axis indicates a Ca content x and the vertical axis indicates a 0.2% tensile yield strength YS.

As shown in FIG. 7, it has been confirmed that when the Ca addition amount is more than 3.75 atomic %, the 0.2% tensile yield strength is drastically increased. Furthermore, it is found that, when the Ca addition amount is 6.25 atomic %, the highest strength is observed, and when Ca is added in an amount of 7.5 atomic % or more, ductility cannot be observed, and the extruded material is broken in elastic limit. Therefore, it has been confirmed that the upper limit of the Ca addition amount is preferably 7 atomic %.

Figure 8:
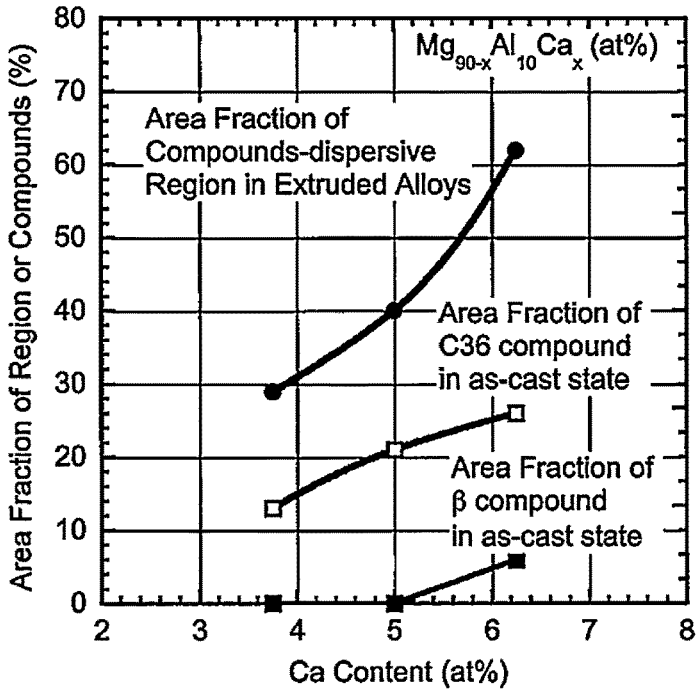
FIG. 8 is a diagram showing a dependency of structure change on the Ca addition amount in the extruded material of $Mg_{90-x}Al_{10}Ca_x$ alloy.

FIG. 8 is a diagram showing a dependency of structure change on the Ca addition amount in the extruded material of $Mg_{90-x}Al_{10}Ca_x$ alloy, and the horizontal axis indicates a Ca content x and the vertical axis indicates the dispersion region of a compound or the volume fraction of a compound.

As shown in FIG. 8, it is found that the β phase ($Al_{12}Mg_{17}$) indicated by "■" is within the range of 0 to 10% as a result of the measurement in a state of casting, that the C36-type compound ($(Mg, Al)_2Ca$) indicated by "□" is within the range of 10 to 30% as a result of the measurement in a state of casting, and a volume fraction of the dispersion region of compound (C36-type compound and the dispersion region of the β phase) indicated by "●" is within the range of 25 to 65% as a result of the measurement in the extruded material. Meanwhile, it can be said that the volume fraction of the dispersion region of the compound is preferably within the range of 35 to 65%, except for the magnesium alloy having a YS of 300 MPa or less.

According to FIG. 7 and FIG. 8, it has been confirmed that as the content of the C36-type compound becomes larger, the 0.2% tensile yield strength is increased.

Figure 9:
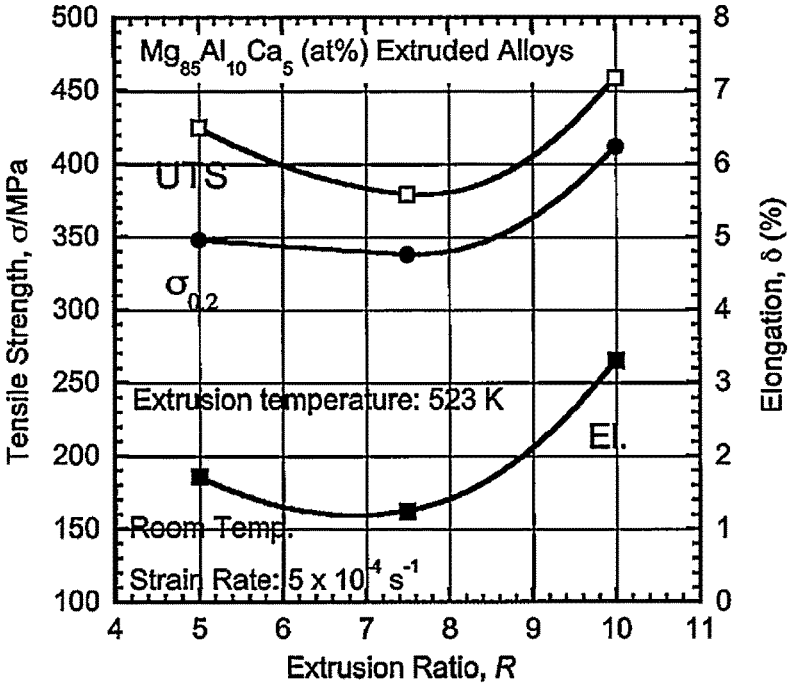
FIG. 9 is a diagram showing a dependency of mechanical properties on the extrusion ratio in the extruded material of $Mg_{85}Al_{10}Ca_5$ alloy.

FIG. 9 is a diagram showing a dependency of mechanical properties on the extrusion ratio in the extruded material of $Mg_{85}Al_{10}Ca_5$ alloy, and the horizontal axis indicates the extrusion ratio, the left-hand vertical axis indicate the tensile strength UTS and the 0.2% tensile yield strength $\sigma_{0.2}$, and the right-hand vertical axis indicates the elongation δ.

As shown in FIG. 9, it has been confirmed that an elongation of 2% or more can be obtained by extrusion-processing at an extrusion ratio of 9 or more (equivalent strain of 2.2 or more).

Figure 10:
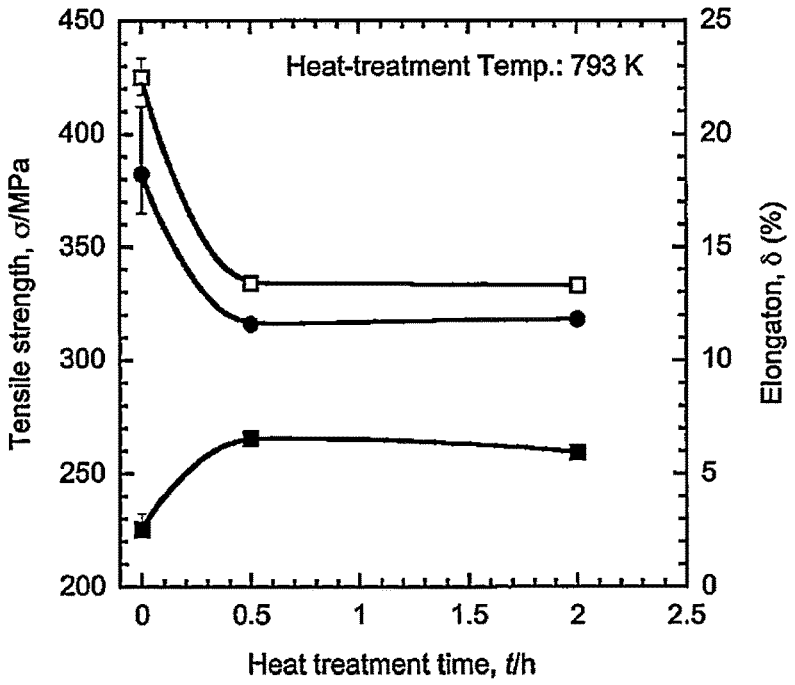
FIG. 10 is a diagram showing the results of the mechanical properties through the tensile test of the heat-treated extruded material of $Mg_{85}Al_{10}Ca_5$ alloy, at room temperature.

FIG. 10 is a diagram showing the results obtained by evaluating, through the tensile test at room temperature, the mechanical properties of the extruded material obtained by heat-treating the $Mg_{85}Al_{10}Ca_5$ alloy cast at a temperature of 793 K for 1 hour, 0.5 hour, and 2 hours, and then by extrusion-processing at an extrusion ratio of 10 and at an extrusion speed of 2.5 mm/sec at a temperature of 523 K, and the horizontal axis indicates the heat-treating period of time, the left-hand vertical axis indicate the tensile strength $\sigma_{UTS}$ and the 0.2% tensile yield strength $\sigma_{0.2}$, and the right-hand vertical axis indicates the elongation δ.

As shown in FIG. 10, the elongation can be enhanced drastically by subjecting the casting product to heat treatment before the plastic working. Meanwhile, it is expected that the effect of the enhancement of elongation can be achieved by heat treatment for about 5 minutes.

Figure 11:
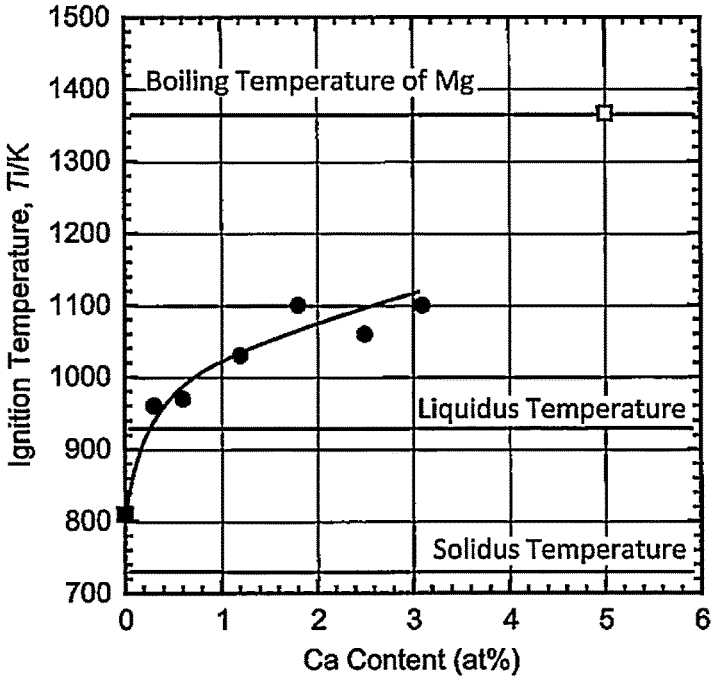
FIG. 11 is a diagram showing a dependency of ignition temperature on the Ca addition amount in the material of $Mg_{85}Al_{10}Ca_5$ alloy.

FIG. 11 is a diagram showing a dependency of ignition temperature on the Ca addition amount in the material of alloys in which Ca is contained in an AZ91-based alloy in an amount of 0 to 3.1 atomic % in accordance with ASTM Standard (Ca-containing AZ91-based Alloys) and $Mg_{85}Al_{10}Ca_5$ alloy, and the horizontal axis indicates a Ca addition amount and the vertical axis indicates an ignition temperature.

According to the combustion test in FIG. 11, it is found that when the Ca addition amount is 3 atomic % or more, the ignition temperature becomes 1123 K (850° C.) or more, and when the Ca addition amount is 5 atomic % or more, the ignition temperature becomes 1363 K (1090° C.) or more.

Figure 12:
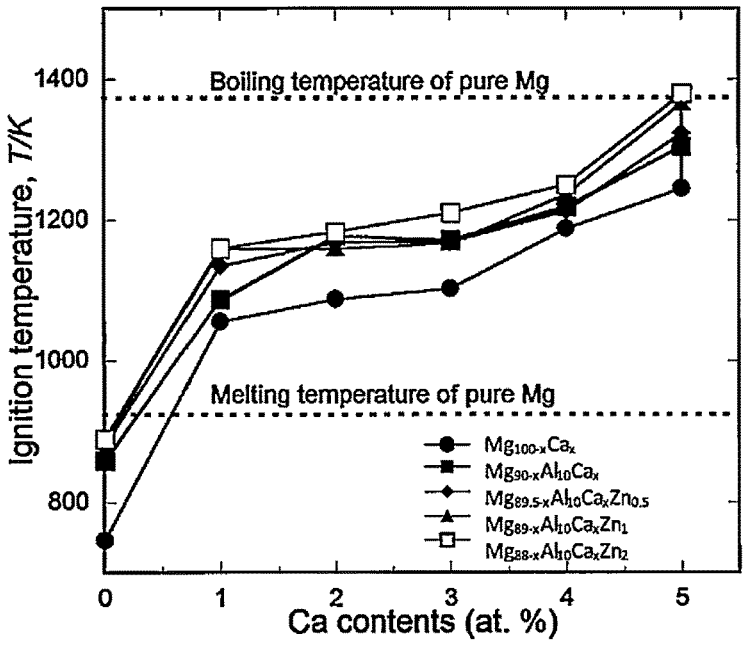
FIG. 12 is a diagram showing a dependency of ignition temperature on the Ca addition amount in the material of $Mg_{100-x}Ca_x$ (x=0 to 5) alloy.

FIG. 12 is a diagram showing a dependency of ignition temperature on the Ca addition amount in each of $Mg_{100-x}Ca_x$ (x=0 to 5) alloy, $Mg_{90}Al_{10}Ca_x$ (x=0 to 5) alloy, $Mg_{89.5-x}Al_{10}Ca_xZn_{0.5}$ (x=0 to 5) alloy, $Mg_{89-x}Al_{10}Ca_xZn_1$ (x=0 to 5) alloy, and $Mg_{88-x}Al_{10}Ca_xZn_2$ (x=0 to 5) alloy, and the horizontal axis indicates a Ca addition amount and the vertical axis indicates an ignition temperature.

According to the combustion test in FIG. 12, it is found that as the Zn addition amount becomes larger, the ignition temperature becomes high.

Figure 13:
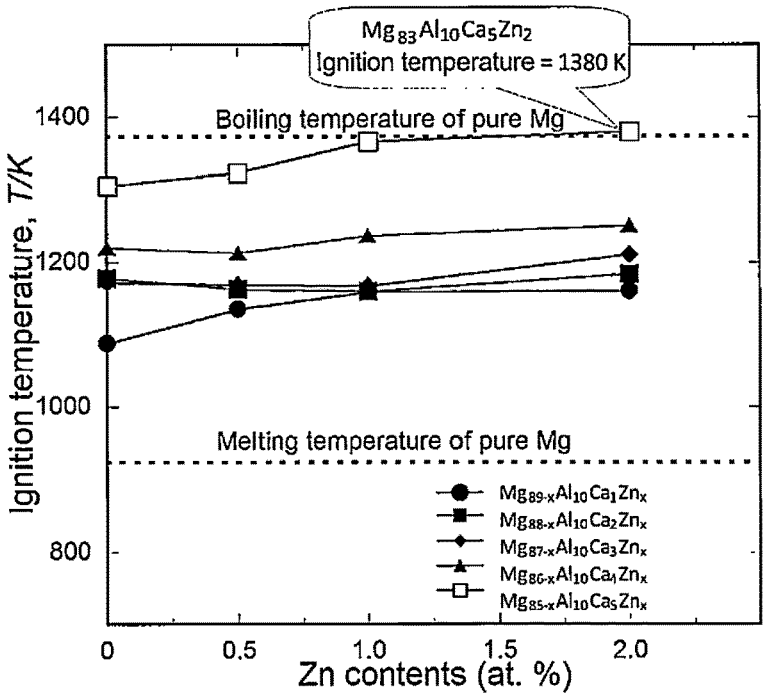

FIG. 13 is a diagram showing a dependency of ignition temperature on the Zn addition amount in each of $Mg_{89-x}Al_{10}Ca_1Zn_x$ (x=0 to 2.0) alloy, $Mg_{88-x}Al_{10}Ca_2Zn_x$ (x=0 to 2.0) alloy, $Mg_{87-1}Al_{10}Ca_3Zn_x$ (x=0 to 2.0) alloy, $Mg_{86-x}Al_{10}Ca_4Zn_x$ (x=0 to 2.0) alloy, and $Mg_{85-x}Al_{10}Ca_5Zn_x$ (x=0 to 2.0) alloy, and the horizontal axis indicates a Zn addition amount and the vertical axis indicates an ignition temperature.

According to the combustion test in FIG. 13, it is found that, when the Ca addition amount becomes larger, the ignition temperature becomes high. In addition, $Mg_{83}Al_{10}Ca_5Zn_2$ alloy exhibits an ignition temperature of 1380 K. Furthermore, as a result of measuring the mechanical properties of the $Mg_{83}Al_{10}Ca_5Zn_2$ alloy produced according to the same way as in the sample shown in Table 1, it has been confirmed that a yield stress is 380 MPa.

Figure 14:
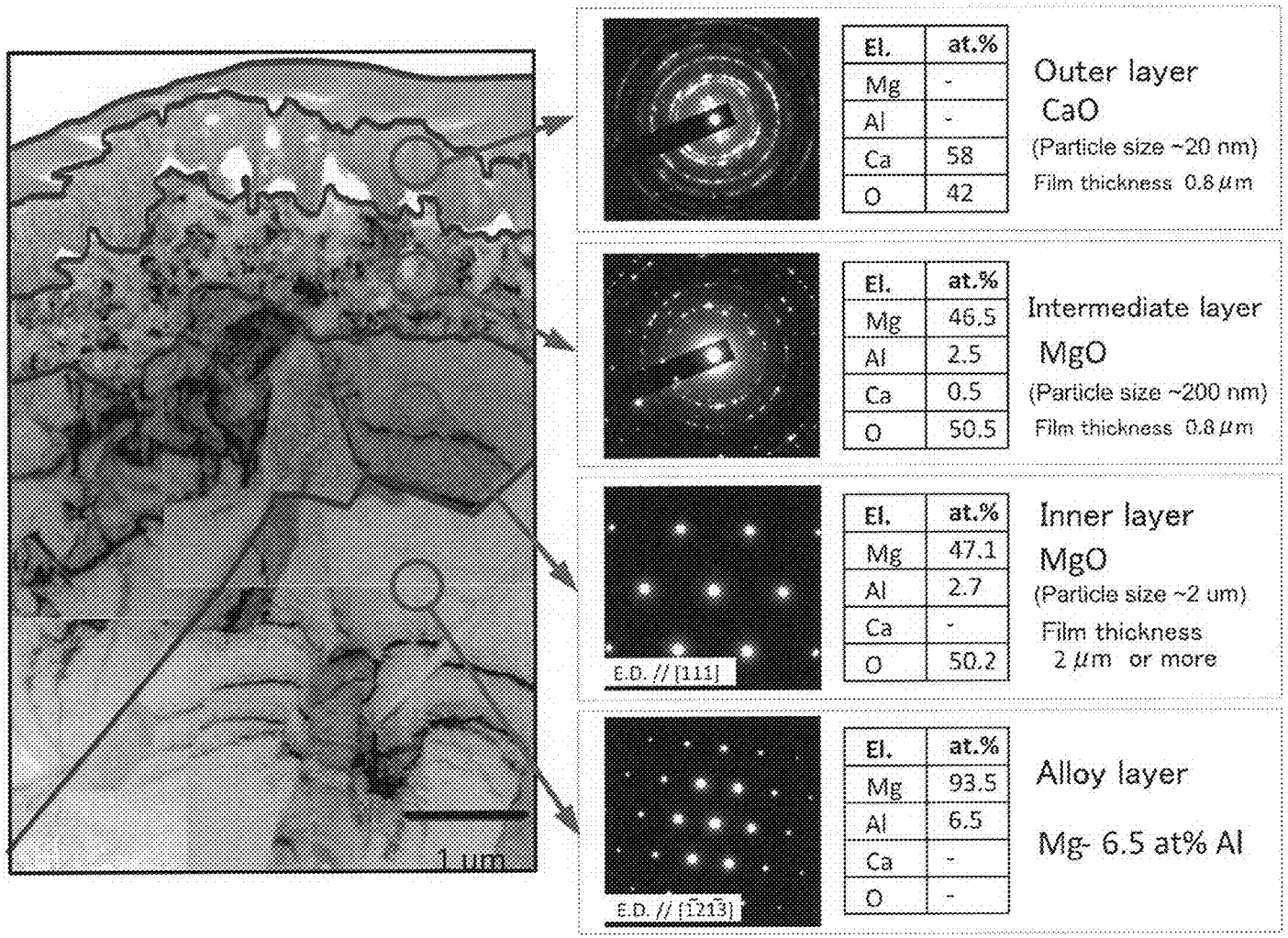
FIG. 14 shows a structure photograph and the analytical results of the surface film of the alloy sample obtained by melting the $Mg_{85}Al_{10}Ca_5$ alloy in the atmosphere.

FIG. 14 shows a structural photograph and the analytical results of the surface film of the alloy sample obtained by melting the $Mg_{85}Al_{10}Ca_5$ alloy in the atmosphere.

Figure 15:
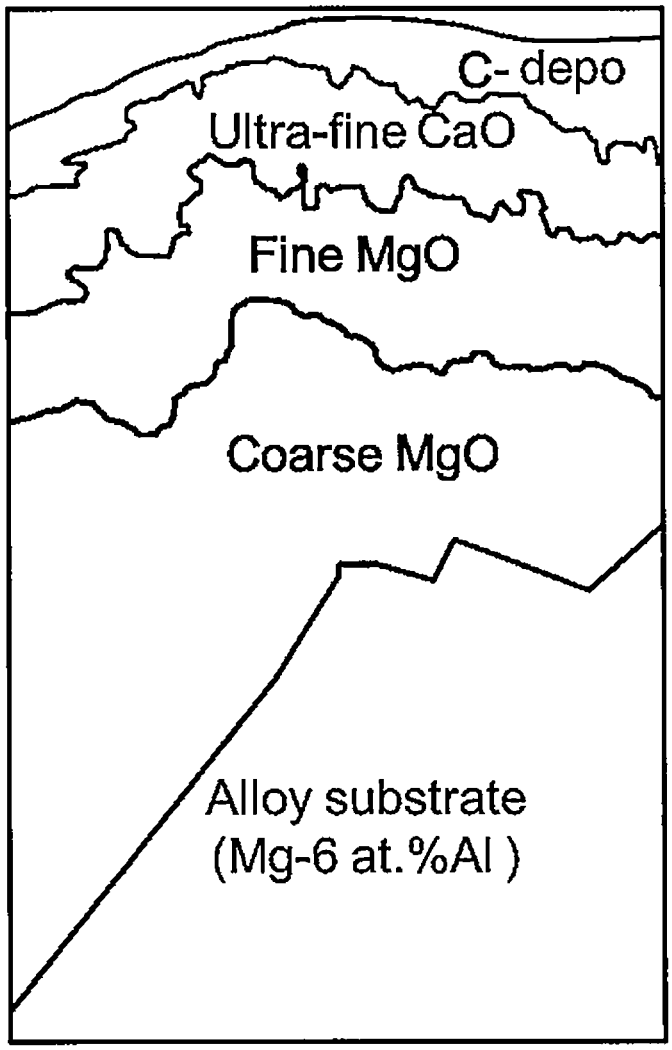
FIG. 15 is a schematic view of the surface film of the alloy sample shown in FIG. 14.

FIG. 15 is a schematic view of the surface film of the alloy sample shown in FIG. 14.

<Mechanism of Expression of Incombustibility>

According to FIG. 14 and FIG. 15, it is found that the surface film formed at melting of the $Mg_{85}Al_{10}Ca_5$ alloy has a three-layered structure, and the surface film is formed of an ultra-fine particle CaO layer, a fine particle MgO layer, a coarse particle MgO layer in this order from the surface layer. It is suggested that the formation of the ultra-fine particle CaO layer at the time of melting greatly contributes to the expression of incombustibility.

(Corrosion Test)

A corrosion test was carried out with respect to the magnesium alloy of the composition shown Table 2. As to a corrosion condition, a corrosion speed was measured by immersion into a 1 wt % NaCl aqueous solution (initial pH=6.8). The results are shown in Table 2.

TABLE 2

Corrosion condition: Immersion into a 1 wt % NaCl aqueous solution (initial pH = 6.8)

| Composition [at. %] | Corrosion speed [mm/year] |
|---|---|
| $Mg_{85}Ca_5Al_{10}$ | 2.85 |
| $Mg_{90}Al_{10}$ | 6.04 |
| $Mg_{95}Ca_5$ | 10.1 |
| $Mg_{84.9}Al_{10}Ca_5Zn_{0.1}$ | 1.57 |
| $Mg_{84.9}Al_{10}Ca_5Mn_{0.1}$ | 0.26 |
| $Mg_{84.9}Al_{10}Ca_5Zr_{0.1}$ | 22.95 |
| $Mg_{84.9}Al_{10}Ca_5Y_{0.1}$ | 9.012 |
| $Mg_{84.9}Al_{10}Ca_5La_{0.1}$ | 4.78 |
| $Mg_{84.9}Al_{10}Ca_5Ce_{0.1}$ | 11.44 |
| $Mg_{84.9}Al_{10}Ca_5Nd_{0.1}$ | 22.2 |

According to Table 2, the $Mg_{84.9}Al_{10}Ca_5Mn_{0.1}$ alloy and $Mg_{84.4}Al_{10}Ca_5Zn_{0.1}$ alloy which are obtained by adding a very small amount of Mn and Zn exhibit extremely high corrosion resistance.

The invention claimed is:

1. A magnesium alloy:

comprising Ca in an amount of "a" atomic %, Al in an amount of "b" atomic % and a residue of Mg, comprising $(Mg, Al)_2Ca$ in an amount of "c" volume %, wherein "a", "b" and "c" satisfy the following equations (1) to (4), and having said $(Mg, Al)_2Ca$ dispersed therein, wherein a volume fraction of region of said dispersed $(Mg, Al)_2Ca$ is "f" %, wherein "f" satisfies the following equation (7), wherein said $(Mg, Al)_2Ca$ is dispersed in a metallographic structure, and wherein the region contains the metallographic structure $$3 \leq a \leq 7 \quad (1)$$

$$4.5 \leq b \leq 12 \quad (2)$$

$$1.2 \leq b/a \leq 3.0 \quad (3)$$

$$10 \leq c \leq 35 \quad (4)$$

$$35 \leq f \leq 65 \quad (7).$$

2. A magnesium alloy:

comprising Ca in an amount of "a" atomic %, Al in an amount of "b" atomic % and a residue of Mg, comprising $(Mg, Al)_2Ca$ in an amount of "c" volume %, wherein "a", "b" and "c" satisfy the following equations (1) to (4), and having said $(Mg, Al)_2Ca$ dispersed therein, wherein a volume fraction of region of said dispersed $(Mg, Al)_2Ca$ is "f" %, wherein "f" satisfies the following equation (7), wherein said $(Mg, Al)_2Ca$ is dispersed in a metallographic structure, wherein the region contains the metallographic structure $$3 \leq a \leq 7 \quad (1)$$

$$8 \leq b \leq 12 \quad (2)$$

$$1.2 \leq b/a \leq 3.0 \quad (3)$$

$$10 \leq c \leq 35 \quad (4)$$

$$35 \leq f \leq 65 \quad (7).$$

3. The magnesium alloy according to claim 1, wherein said magnesium alloy further comprises Zn in an amount of "x" atomic %, wherein "x" satisfies the following equation (20)

$$0 < x \leq 3 \quad (20).$$

4. The magnesium alloy according to claim 1, wherein said magnesium alloy further comprises $Al_{12}Mg_{17}$ in an amount of "d" volume %, wherein "d" satisfies the following equation (5)

$$0 < d \leq 10 \quad (5).$$

5. The magnesium alloy according to claim 1, wherein a crystal particle size of said dispersed $(Mg, Al)_2Ca$ is "e", wherein "e" satisfies the following equation (6)

$$1\text{nm} \leq e \leq 2\mu\text{m} \quad (6).$$

6. The magnesium alloy according to claim 1, wherein an ignition temperature of said magnesium alloy is 850° C or more.

7. The magnesium alloy according to claim 1, wherein said "a" and "b" satisfy the following equations (1') and (2')

$$4 \leq a \leq 6.5 \quad (1')$$

$$7.5 \leq b \leq 11 \quad (2').$$

8. The magnesium alloy according to claim 7, wherein said "a" and "b" satisfy the following equation (3')

$$11/7 \leq b/a \leq 12/5 \quad (3').$$

9. The magnesium alloy according to claim 7, wherein an ignition temperature of said magnesium alloy is 1090° C. or more.

10. The magnesium alloy according to claim 1, wherein when compression yield strength is "g" and tensile yield strength is "h", "g" and "h" of said magnesium alloy satisfy the following equation (8)

$$0.8 \leq g/h \quad (8).$$

11. The magnesium alloy according to claim 1, wherein said magnesium alloy contains at least one element selected from the group consisting of Mn, Zr, Si, Sc, Sn, Ag, Cu, Li, Be, Mo, Nb, W and a rare-earth metal in an amount of "i" atomic %, where "i" satisfies the following equation (9)

$$0 < i \leq 0.3 \quad (9).$$

12. The magnesium alloy according to claim 1, wherein said magnesium alloy contains at least one compound selected from the group consisting of $A1_2O_3$, $Mg_2Si$, SiC, MgO and CaO in an amount of "j" atomic % as an amount of metal atom in the compound, where "j" satisfies the following equation (10)

$$0 < j \leq 5 \quad (10).$$

* * * * *